US011319951B2

(12) United States Patent
Yanagibayashi et al.

(10) Patent No.: US 11,319,951 B2
(45) Date of Patent: May 3, 2022

(54) PLUNGER PUMP

(71) Applicant: SHIMADZU CORPORATION, Kyoto (JP)

(72) Inventors: Jun Yanagibayashi, Kyoto (JP); Shinya Imamura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/762,399

(22) PCT Filed: Nov. 29, 2017

(86) PCT No.: PCT/JP2017/042737
§ 371 (c)(1),
(2) Date: May 7, 2020

(87) PCT Pub. No.: WO2019/106738
PCT Pub. Date: Jun. 6, 2019

(65) Prior Publication Data
US 2020/0263686 A1 Aug. 20, 2020

(51) Int. Cl.
*F04B 53/22* (2006.01)
*F04B 53/14* (2006.01)
*F04B 53/16* (2006.01)

(52) U.S. Cl.
CPC ..... *F04B 53/14* (2013.01); *F04B 53/16* (2013.01); *F04B 53/22* (2013.01)

(58) Field of Classification Search
CPC ..... F04B 53/14; F04B 53/22
See application file for complete search history.

(56) References Cited

U.S. PATENT DOCUMENTS 5,938,416 A 8/1999 Saito
2012/0118141 A1* 5/2012 Maeda ..... F04B 53/164 92/168

FOREIGN PATENT DOCUMENTS

JP 11324905 A * 11/1999

OTHER PUBLICATIONS

International Search Report for corresponding Application No. PCT/JP2017/042737, dated Mar. 6, 2018.

* cited by examiner

*Primary Examiner* — F Daniel Lopez
(74) *Attorney, Agent, or Firm* — Renner, Otto, Boisselle & Sklar, LLP

(57) ABSTRACT

Even though a pump head part is finally fixed to a pump body with a fixing member, the pump head part is movable relative to the pump body perpendicular to the axial direction of a plunger at a stage before the pump head part is fixed with the fixing member. In this state, if a plunger driving part is moved to a predetermined location on the front end side of the pump body and the pump head part and the plunger driving part are fitted to each other, the pump head part is positioned where the center axis of the plunger and the center axis of the pump chamber are substantially aligned. By fixing the pump head part to the pump body with the fixing member at this location, it is possible to assemble a plunger pump with the center axis of the plunger and the center axis substantially aligned.

5 Claims, 6 Drawing Sheets

PLUNGER PUMP

TECHNICAL FIELD

The present invention relates to a plunger pump used for feeding a mobile phase in an analytical instrument such as a high-performance liquid chromatograph (HPLC) or a supercritical fluid chromatograph (SFC).

BACKGROUND ART

As a liquid feeding pump for feeding a mobile phase in a HPLC or a SFC, a double plunger pump in which two plunger pumps are connected in series or in parallel is often used. Each plunger pump is configured in such a way that a plunger driving part that holds a plunger at a front end and moves in the axial direction of the plunger is housed in a pump body, and a pump head is disposed at a front end of the pump body. The plunger protrudes into the pump head from the front end of the pump body and reciprocates while sliding in the axial direction in a pump chamber provided in the pump head. As a result, suction of liquid into the pump chamber and discharge of the liquid from the pump chamber are performed continuously.

In the vicinity of the pump chamber of the pump head, a plunger seal is provided for keeping liquid-tightness of the outer peripheral surface of the plunger to prevent liquid leakage from the pump chamber. The plunger seal is a consumable item whose inner peripheral surface is worn by sliding on the outer peripheral surface of the plunger, and requires regular replacement. If the plunger seal is worn, liquid leaks from the pump chamber toward the pump body, resulting in contamination and poor liquid feeding.

An example of the factors that promote wear of the plunger seal is relative eccentricity between the plunger and the pump chamber, that is, relative displacement between the center axis of the plunger and the center axis of the pump chamber. If the center axis of the plunger and the center axis of the pump chamber are aligned, the plunger passes through the center of the plunger seal. Therefore, frictional force between the outer peripheral surface of the plunger and the inner peripheral surface of the plunger seal acts uniformly, and wear of the inner peripheral surface of the plunger seal progresses uniformly.

However, since there are manufacturing tolerances in components such as a pump head, a pump body, and a plunger driving part that constitute the plunger pump, even if the pump head is correctly disposed with respect to the pump body, the center axis of the plunger may be shifted from the center axis of the pump chamber in many cases. If the center axis of the plunger is shifted from the center axis of the pump chamber, the frictional force between the outer peripheral surface of the plunger and the inner peripheral surface of the plunger seal upon operation of the plunger becomes uneven on the inner peripheral surface of the plunger seal, the wear of the plunger seal locally progresses, and the longevity of the plunger seal is shortened.

Therefore, a technique has been proposed and implemented in which a plunger driving part is made to be swingable so that the eccentricity of a plunger with respect to a pump chamber is passively adjusted (see Patent Document 1).

PRIOR ART DOCUMENT

Patent Document

Patent Document 1: U.S. Pat. No. 5,938,416

SUMMARY OF THE INVENTION

Problems to be Solved by the Invention

According to the technique disclosed in Patent Document 1, a plunger driving part is held by an O-ring, and a base end of the plunger driving is not fixed so as to be swingable. However, it has been found that even if such a structure is adopted, if the relative eccentricity between a plunger and a pump chamber is great or the mounting state of the O-ring is bad, the relative eccentricity between the plunger and the pump chamber is not sufficiently adjusted in some cases.

The present invention has been made in view of the above problems, and an object of the present invention is to provide a plunger pump having a structure that can be assembled in a state where relative eccentricity between a plunger and a pump chamber is small.

Solution to the Problems

According to the present invention, it is possible to adjust the relative positional relationship between a plunger and a pump head part so that the center axis of a pump chamber and the center axis of the plunger are substantially aligned, at the stage of assembling the pump head part to a pump body.

A plunger pump according to the present invention includes a pump body, a plunger, a plunger driving part, and a pump head part. The plunger driving part is configured to move in the pump body in an axial direction of the plunger while holding a base end of the plunger at a front end thereof so as to protrude the plunger from a front end of the pump body. The pump head part includes a pump head in which a pump chamber into which a front end section of the plunger is inserted is provided therein, and is fixed to the front end of the pump body.

In a first aspect of the plunger pump according to the present invention, the pump head part has a shape of being fitted to the plunger driving part coming to a predetermined location on the front end side of the pump body in a state where the center axis of the plunger and the center axis of the pump chamber are substantially aligned, and the pump head part is fixed to the front end of the pump body while keeping a positional relationship capable of being fitted to the plunger driving part after being disposed at the front end of the pump body so as to be movable relative to the pump body in a direction perpendicular to the axial direction of the plunger.

That is, in the first aspect of the present invention, even though the pump head part is finally fixed to the pump body with a fixing member such as a bolt, the pump head part is movable relative to the pump body in the direction perpendicular to the axial direction of the plunger at a stage before the pump head part is fixed to the pump body with the fixing member. In this state, if the plunger driving part is moved to the predetermined location on the front end side of the pump body and the pump head part and the plunger driving part are fitted to each other, the pump head part is positioned at such a location where the center axis of the plunger and the center axis of the pump chamber are substantially aligned. By fixing the pump head part to the pump body with the fixing member at this location, it is possible to assemble the plunger pump with the center axis of the plunger and the center axis of the pump chamber substantially aligned.

A preferable configuration of the first aspect is a configuration in which the pump head part includes a pump head part main body provided with the pump head, and a pump head holding member. The pump head holding member is provided separately from the pump head part main body and holds the pump head part main body by being fitted to a base end section of the pump head part main body. The pump head holding member has a shape of being fitted to the plunger driving part coming to the predetermined location, and the pump head holding member is fixed to the front end of the pump body while keeping a positional relationship capable of being fitted to the plunger driving part after being disposed at the front end of the pump body in a state of being movable in the direction perpendicular to the axial direction of the plunger.

According to the above configuration, in the pump head part, the pump head holding member is fixed to the pump body first, and the pump head part main body is mounted to the pump head holding member. Since the pump head holding member is fitted to the base end section of the pump head part to hold the pump head part, if the pump head holding member is fixed to the correct location, the pump head part main body can be mounted to a correct location, that is, a location where the center axis of the plunger and the center axis of the pump chamber are substantially aligned. Accordingly, when the pump head part is replaced, only the pump head part main body can be replaced with the pump head holding member fixed to the pump body. Therefore, it is not necessary to perform positioning of the pump head part again.

In a second aspect of the plunger pump according to the present invention, the plunger driving part includes a plunger driving part main body configured to move in the pump body in the axial direction of the plunger, and a plunger holding section mounted to the plunger driving part main body and holding a base end of the plunger so that the plunger protrudes from the front end of the pump body, and the plunger holding section has a shape of being fitted to the pump head part coming to the predetermined location on the front end side of the pump body in a state where the center axis of the plunger and the center axis of the pump chamber are substantially aligned, and the pump plunger holding section is fixed to the plunger driving part main body while keeping a positional relationship capable of being fitted to the pump head part after being disposed at a front end section of the plunger driving part main body in a state of being movable in a direction perpendicular to an axial direction of the plunger.

That is, in the second aspect of the present invention, even though the plunger holding section of the plunger driving part is finally fixed to the plunger driving part main body with a fixing member such as a bolt, the plunger holding section is movable relative to the plunger driving part main body in the direction perpendicular to the axial direction of the plunger at a stage before the plunger holding section is fixed to the plunger driving part main body with the fixing member. In this state, if the plunger driving part is moved to the predetermined location on the front end side of the pump body and the pump head part and the plunger driving part are fitted to each other, the plunger holding section is positioned at such a location where the center axis of the plunger and the center axis of the pump chamber are substantially aligned. By fixing the plunger holding section to the plunger driving part main body with the fixing member at this location, it is possible to assemble the plunger pump with the center axis of the plunger and the center axis of the pump chamber substantially aligned.

Also in the second aspect, the pump head part can include a pump head part main body provided with the pump head, and a pump head holding member provided separately from the pump head part main body and holds the pump head main body by being fitted to a base end section of the pump head part main body. In this case, the plunger holding section has a shape of being fitted to part of the pump head holding member coming to the predetermined location on the front end side of the pump body.

Effects of the Invention

In the first aspect of the plunger pump according to the present invention, at a stage before the pump head part is fixed to the pump body with the fixing member, by only moving the plunger driving part to the predetermined location on the front end side of the pump body and fitting the pump head part to the plunger driving part, the pump head part can be positioned at a location where the center axis of the plunger and the center axis of the pump chamber are substantially aligned. Accordingly, it is possible to assemble the plunger pump with the center axis of the plunger and the center axis of the pump chamber substantially aligned and it is possible to suppress a decrease in the longevity of a plunger seal due to relative eccentricity between the plunger and the pump chamber.

In the second aspect of the plunger pump according to the present invention, at a stage before the plunger holding section of the plunger driving part is fixed to the plunger driving part main body with the fixing member, by only moving the plunger driving part to the predetermined location on the front end side of the pump body and fitting the pump head part to the plunger driving part, the plunger holding section can be positioned at a location where the center axis of the plunger and the center axis of the pump chamber are substantially aligned. Accordingly, it is possible to assemble the plunger pump with the center axis of the plunger and the center axis of the pump chamber substantially aligned, and it is possible to suppress a decrease in the longevity of a plunger seal due to relative eccentricity between the plunger and the pump chamber.

EMBODIMENTS OF THE INVENTION

Hereinafter, preferred embodiments of a plunger pump according to the present invention will be described with reference to the drawings.

Figure 1:
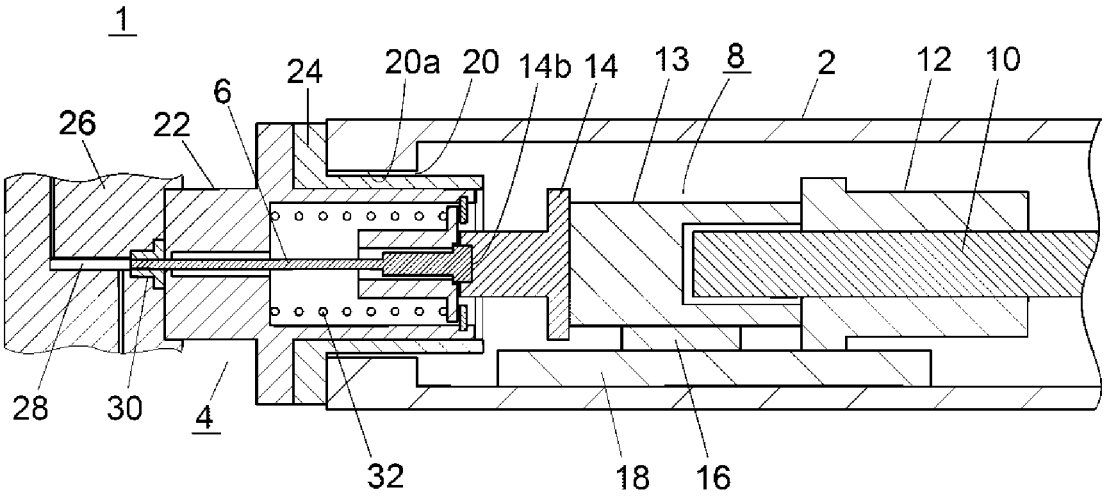
FIG. 1 is a cross-sectional view illustrating one embodiment of a plunger pump.

As illustrated in FIG. 1, a plunger pump 1 includes a pump body 2, a pump head part 4, a plunger 6, and a plunger driving part 8. The pump head part 4 is mounted to a front end of the pump body 2. The plunger driving part 8 is housed in the pump body 2 and holds a base end of the plunger 6 at a front end thereof.

The plunger driving part 8 includes a plunger driving part main body 13, a nut 12 that is provided on the base end side of the plunger driving part main body 13 and is screwed with a ball screw 10 extending in the axial direction of the plunger 6, and a plunger holding section 14 that holds a base end of the plunger 6 at the front end side of the plunger driving part main body 13. The ball screw 10 is rotated by a motor (not illustrated). A guide rail 18 extending in the axial direction of the plunger 6 is provided in the pump body 2, and part of the nut 12 is supported so as to be slidable in the axial direction of the plunger 6, and the nut 12 does not rotate even if the ball screw 10 rotates. A slide block 16 mounted to the plunger driving part 8 also slides in the axial direction of the plunger 6 along the guide rail 18. Therefore, when the ball screw 10 rotates, the plunger driving part 8 moves in the axial direction of the plunger 6. Note that the mechanism for moving the plunger driving part 8 does not need to use the ball screw 10 and the nut 12, and may use a cam mechanism.

The pump head part 4 includes a pump head part main body 22 and a pump head holding member 24. The pump head part main body 22 includes a pump head 26 in which a pump chamber 28 is provided. A front end section of the plunger 6 protruding from the front end of the pump body 2 is inserted into the pump chamber 28. A plunger seal 30 that keeps liquid-tightness of the outer peripheral surface of the plunger 6 is provided at a location near the pump chamber 28 where the plunger 6 is inserted into the pump chamber 28, and the base end-side end surface of the pump chamber 28 is sealed by the plunger seal 30.

An elastic member 32 such as a coil spring is housed in the pump head part main body 22, and a base end section of the plunger 6 is urged toward the plunger holding section 14 by elastic force of the elastic member 32. The base end section of the plunger 6 is fitted into a recess 14*b* provided in a front end surface of the plunger holding section 14, and is urged by the elastic member 32 toward the plunger holding section 14. As a result, the plunger 6 is stably held by the plunger holding section 14. The inner diameter d2 of the recess 14*b* is designed to be substantially identical to the outer diameter d1 of the base end section of the plunger 6 (see FIG. 2), the base end section of the plunger 6 and the recess 14 are fitted to each other, and the center axis of the plunger 6 and the center axis of the plunger holding section 14 are substantially aligned.

Figure 2:
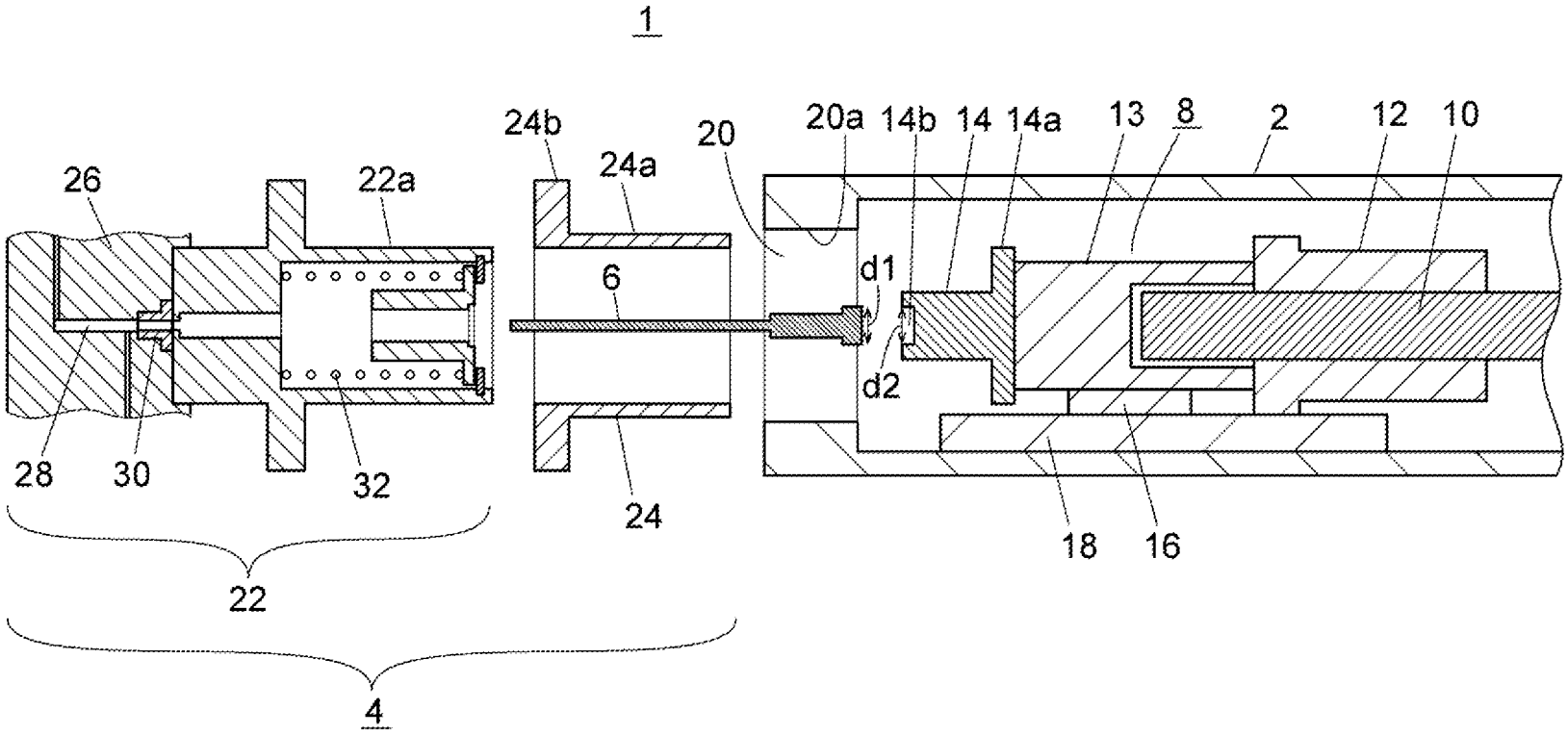
FIG. 2 is an exploded cross-sectional view of the embodiment.

As illustrated in FIG. 2, the pump head holding member 24 includes a hollow cylindrical section 24*a* and a flange section 24*b* provided at a front end section of the cylindrical section 24, and the pump head holding member 24 is mounted to the front end of the pump body 2 when the cylindrical section 24*a* is inserted into a circular opening 20 provided in a front end surface of the pump body 2. The outer diameter of the cylindrical section 24*a* of the pump head holding member 24 is designed to be slightly smaller than the inner diameter of the opening 20 of the pump body 2, and a small gap is formed between the inner peripheral surface 20*a* of the opening 20 and the outer peripheral surface of the cylindrical section 24*a*.

A cylindrical section 22*a* having the outer diameter substantially equal to the inner diameter of the pump head holding member 24 is provided on the base end side of the pump head part main body 22. The pump head part main body 22 and the pump head holding member 24 are fitted to each other when the cylindrical section 22*a* of the pump head part main body 22 is inserted into the pump head holding member 24, and the pump head part main body 22 is held by the holding member 24. Since the cylindrical section 22*a* of the pump head part main body 22 and the pump head holding member 24 are fitted to each other, the pump head part main body 22 is positioned with respect to the pump head holding member 24 only by inserting the cylindrical section 22*a* into the pump head holding member 24.

In the plunger pump 1 according to this embodiment, when the pump head part 4 is mounted to the pump body 2, first, the cylindrical section 24*a* of the pump head holding member 24 is inserted into the opening 20 of the pump body 2 and the pump head holding member 24 is positioned. Then, the pump head holding member 24 is fixed to the pump body 2 by using a fixing member such as a bolt, and the pump head part main body 22 is mounted to the pump head holding member 24. The positioning of the pump head holding member 24 is performed by adjusting the relative positional relationship with the plunger holding section 14.

Figure 3:
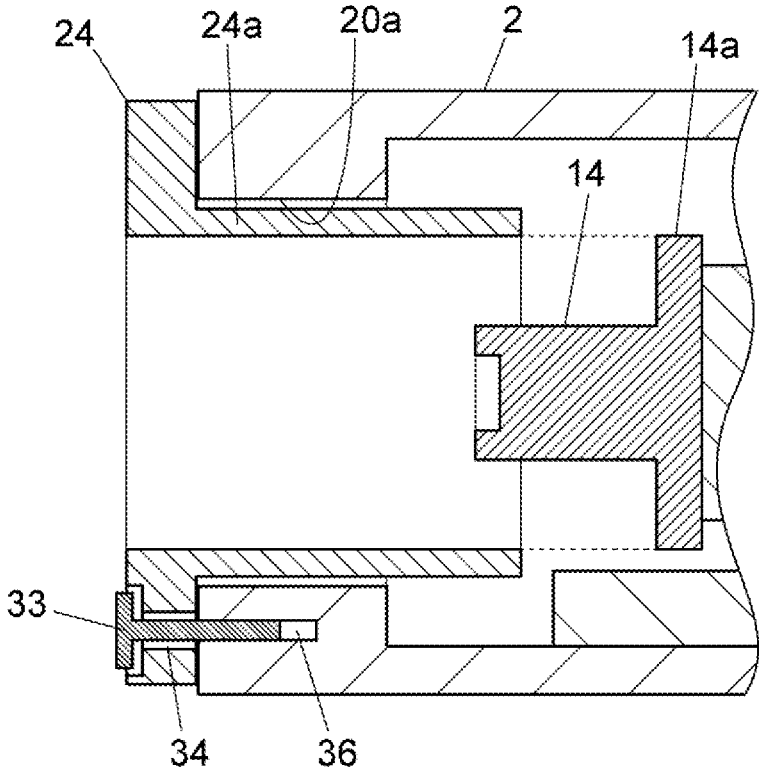
FIG. 3 is a cross-sectional view illustrating a state before positioning a pump head holding member in the embodiment.

As illustrated in FIG. 3, a flange section 14*a* having the outer diameter substantially equal to the inner diameter of the pump head holding member 24 is provided at a base end section of the plunger holding section 14, and the flange section 14*a* and the pump head holding member 24 are fitted to each other.

The pump head holding member 24 is fixed to the pump body 2 with a bolt 33 (fixing member). The inner diameter of a hole 34 for the bolt 33 of the pump head holding member 24 is larger than the diameter of the bolt 33. At a stage before the bolt 33 is tightened into a bolt hole 36 of the pump body 2, the pump head holding member 24 is slightly movable in a direction perpendicular to the axial direction of the plunger 6. As a result, fine adjustment of the position at a front end section of the pump body 2 can be performed.

Figure 4:
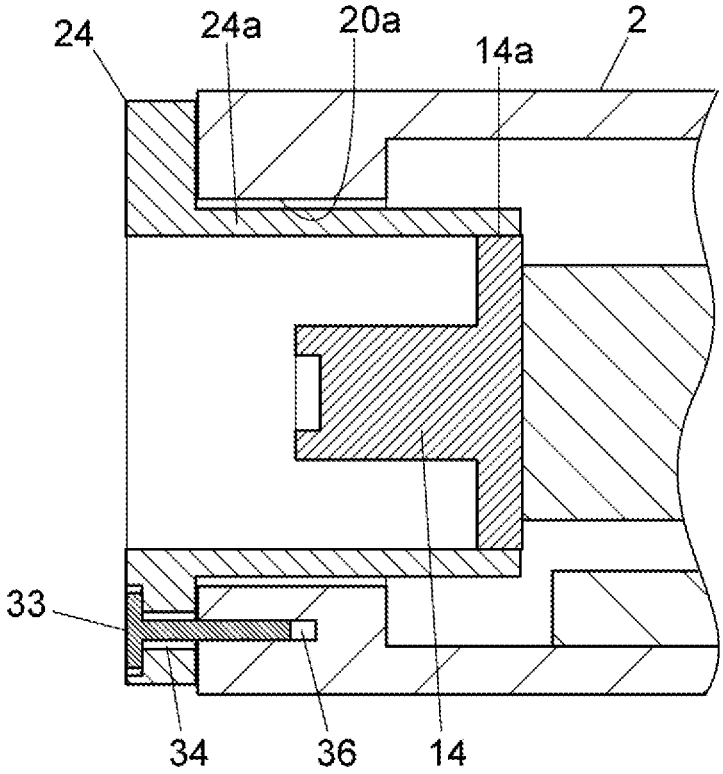
FIG. 4 is a cross-sectional view illustrating a state after positioning the pump head holding member in the embodiment.

When the pump head holding member 24 is positioned, the ball screw 10 is rotated so that the plunger driving part 8 is moved to a predetermined location (location where the flange section 14*a* of the plunger holding section 14 reaches the base end section of the pump head holding member 24) on the front end side of the pump body 2, in a state where the pump head holding member 24 is movable in the direction perpendicular to the axial direction of the plunger 6. At this time, as illustrated in FIG. 4, the position of the pump head holding member 24 is adjusted so that the flange section 14*a* of the plunger holding section 14 is fitted to the inside of the pump head holding member 24, the bolt 33 is tightened in a state where the flange section 14*a* and the pump head holding member 24 are fitted with each other to fix the position of the pump head holding member 24. As a result, the pump head holding member 24 is fixed in a positional relationship in which the pump head holding member 24 and the plunger holding section 14 can be fitted to each other. Since the plunger holding section 14 and the pump head holding member 24 are in a positional relationship capable of being fitted to each other, the center axes of the plunger holding section 14 and the pump head holding member 24 are substantially aligned.

After the positioning of the pump head holding member is completed, the cylindrical section 22*a* of the pump head part main body 22 is inserted into the pump head holding member 24, and the pump head part main body 22 is fixed to the pump head holding member 24 with a fixing member such as the bolt. Thus, mounting of the pump head part 4 to the pump body 2 is completed.

As described above, the center axis of the plunger holding section 14 and the center axis of the plunger 6 are designed to be aligned by fitting the base end section of the plunger 6 and the recess 14*b* of the plunger holding member 14 to each other. Since the plunger 6 and the plunger holding section 14 can be manufactured with high dimensional accuracy, the center axis of the plunger 6 and the center axis of the plunger holding section 14 are substantially aligned.

Further, the pump head part 4 is designed so that when the cylindrical section 24*a* of the pump head part main body 22 and the pump head holding member 24 are fitted to each other, the center axis of the pump chamber 28 in the pump head 26 and the center axis of the pump head holding member 24 are aligned. Since the pump head part main body 22 and the pump head holding member 24 can be manufactured with high dimensional accuracy, the center axis of the pump chamber 28 and the center axis of the head holding member 24 are substantially aligned when the cylindrical section 24*a* and the pump head holding member 24 are fitted with each other.

From these relationships, if the pump head holding member 2 is fixed in a positional relationship of being able to be fitted to the plunger holding section 14, the center axis of the plunger 6 and the center axis of the pump chamber 28 are substantially aligned.

As described above, in the plunger pump 1 according to this embodiment, the position of the pump head part 4 can be adjusted to a position where the center axis of the pump chamber 28 and the center axis of the plunger 6 are substantially aligned when the pump head part 4 is assembled to the pump body 2. Furthermore, in this embodiment, since the pump head part 4 includes the pump head holding section 24 separately from the pump head part main body 22, only the pump head part main body 22 can be replaced in a state where the pump head holding section 24 is mounted to the pump body 2. Therefore, it is not necessary to perform positioning of the pump head holding section 24 again.

Note that in the above-described embodiment, the structure in which the position on the pump head part 4 side is adjusted so that the center axis of the plunger 6 and the center axis of the pump chamber 28 are substantially aligned has been described; however, a structure in which the position on the plunger 6 side is adjusted is possible.

Figure 5:
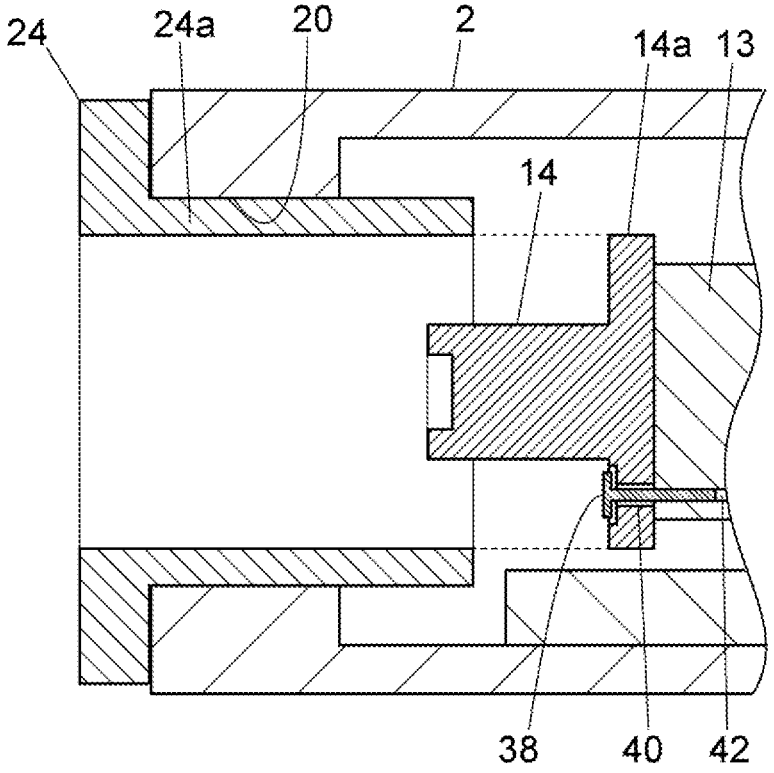
FIG. 5 is a cross-sectional view illustrating another embodiment of the plunger pump, illustrating a state before positioning of a plunger holding member.
Figure 6:
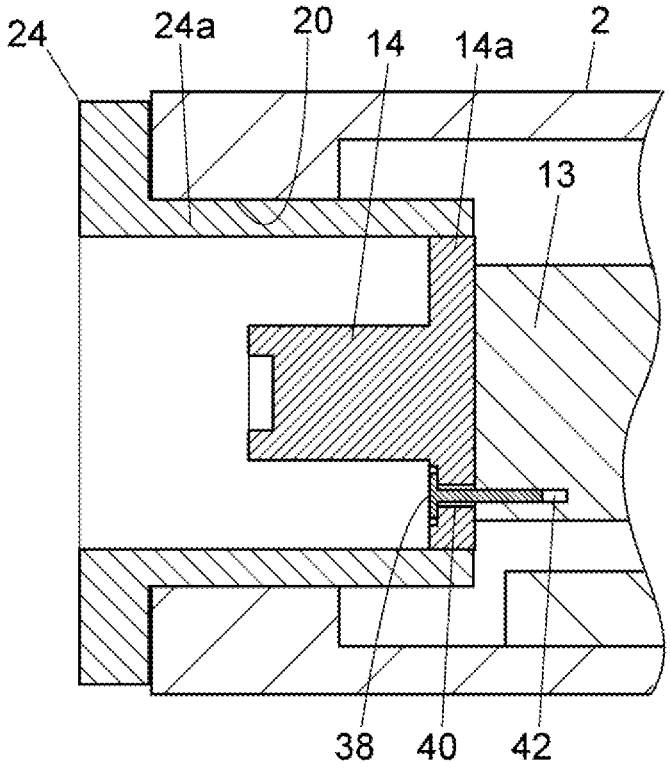
FIG. 6 is a cross-sectional view illustrating a state after positioning the plunger holding member in the other embodiment.

FIGS. 5 and 6 illustrate an example of a structure of adjusting the position on the plunger 6 side. In this embodiment, a cylindrical section 24*a* of a pump head holding member 24 has an outer diameter substantially identical to the inner diameter of an opening 20 of a pump body 2, and the pump head holding member 24 does not move in a direction perpendicular to the axial direction of a plunger 6. A plunger holding section 14 is fixed to a plunger driving part main body 13 by a bolt 38. A hole 40 for the bolt 38 of the plunger holding section 14 is larger than the diameter of the bolt 38, and at a stage before the bolt 38 is tightened into a bolt hole 42 of the plunger driving part main body 13, the plunger holding section 14 is slightly movable in the direction perpendicular to the axial direction of the plunger 6. Therefore, fine adjustment of the position of the plunger holding section 14 can be performed.

When the plunger holding section 14 is positioned, a ball screw 10 is rotated so that a plunger driving part 8 is moved to a predetermined location (location where a flange section 14*a* of the plunger holding section 14 reaches a base end section of the pump head holding member 24) on the front end side of a pump body 2, in a state where the plunger holding section 14 is movable in the direction perpendicular to the axial direction of the plunger 6. At this time, as illustrated in FIG. 6, the position of the plunger holding section 14 is adjusted so that the flange section 14*a* of the plunger holding section 14 is fitted to the inside of the pump head holding member 24, the bolt 38 is tightened in a state where the flange section 14*a* and the pump head holding member 24 are fitted to each other to fix the position of the plunger holding section 14. As a result, the plunger holding section 14 is fixed to the plunger driving part main body 13 in a position where the plunger holding section 24 can be fitted to the pump head holding member 24, and the center axes of the plunger holding section 14 and the plunger driving part main body 13 are substantially aligned.

As described above, the center axis of the plunger 6 and the center axis of the plunger holding section 14 are substantially aligned, and the center axis of a pump chamber 28 and the center axis of the pump head holding member 24 are substantially aligned. Therefore, the plunger holding section 14 is fixed to the plunger driving part main body 13 in a position where the plunger holding section 14 can be fitted to the pump head holding member 24, and thus the center axis of the plunger 6 and the center axis of the pump chamber 28 are substantially aligned.

In the embodiments described above, the structure has been described in which the position of one of the plunger holding section 14 or the pump head holding member 24 is finely adjusted so that the center axis of the plunger 6 and the center axis of the pump chamber 28 are substantially aligned. However, the present invention is not limited to this, and may be configured so that the positions of both the plunger holding section 14 and the pump head holding member 24 can be adjusted.

In addition, although the pump head holding member 24 of the pump head part 4 is provided separately from the pump head part main body 22, the present invention is not limited to this. A pump head holding member 24 may be provided integrally with a pump head part main body 22. In short, it is sufficient that part of a pump head part 4 and part of a plunger driving part 8 have shapes that are fitted to each other when the plunger driving part 8 is moved to a predetermined location, and positioning can be performed so that the center axis of a plunger 6 and the center axis of a pump chamber 28 are substantially aligned by using fitting of both the part of the pump head part 4 and the part of the plunger driving part 8.

In addition, although not described in the above embodiments, a pump head part main body 22 has a structure capable of supplying a cleaning liquid to a location on the base end side (right side in FIG. 1) with respect to a plunger seal 30 to clean a plunger 6.

DESCRIPTION OF REFERENCE SIGNS

1: Plunger pump
2: Pump body
4: Pump head part
6: Plunger
8: Plunger driving part
10: Ball screw
12: Nut
13: Plunger driving part main body
14: Plunger holding section
14*a*: Flange section (Plunger holding section)
14*b*: Recess (Plunger holding section)
16: Slide block
18: Guide rail
20: Opening
20*a*: Inner peripheral surface
22: Pump head part main body

22*a*: Cylindrical section (Pump head part main body)
24: Pump head holding member
24*a*: Cylindrical section (Pump head holding member)
24*b*: Flange section (Pump head holding member)
26: Pump head
28: Pump chamber
30: Plunger seal
32: Elastic body
33, 38: Bolt
34, 40: Through hole for bolt
36, 42: Bolt hole

The invention claimed is:

1. A plunger pump comprising:

a pump body;

a plunger;

a plunger driving part configured to move in the pump body in an axial direction of the plunger while holding a base end of the plunger at a front end so that the plunger protrudes from a front end of the pump body; and a pump head part including a pump head in which a pump chamber into which a front end section of the plunger is inserted is provided therein, wherein the pump head part includes a pump head part main body and a pump head holding member, the pump head holding member being configured to fit to and hold the pump head part main body and has a shape in order to be fit to the plunger driving part upon the plunger driving part being driven to a predetermined location on a front end side of the pump body such that a center axis of the plunger and a center axis of the pump chamber included in the pump head are substantially aligned, and with the pump holding member being disposed at a front end of the pump body in a state of being movable relative to the pump body in a direction perpendicular to the center axis of the, and thereafter being fixed to the front end of the pump body.

2. The plunger pump according to claim 1, wherein the pump head holding member is configured to be fitted to a base end section of the pump head part main body.

3. The plunger pump according to claim 1, wherein the pump head part main body is configured to be fitted to the pump head holding member by being inserted inside of the pump head holding member.

4. The plunger pump according to claim 1, wherein the pump head holding member is fixed to the pump body with a fixing member.

5. The plunger pump according to claim 4, wherein the fixing member is a bolt.

* * * * *